United States Patent [19]

Knox

[11] 4,193,330

[45] Mar. 18, 1980

[54] COPY MACHINE WITH AUTOMATIC ROLL SUPPLIED COPY PAPER FEEDING AND CUTTING APPARATUS AND CONTROL CIRCUITRY

[75] Inventor: Michael P. Knox, Stillwater, Minn.

[73] Assignee: Minnesota Mining and Manufacturing Company, St. Paul, Minn.

[21] Appl. No.: 945,407

[22] Filed: Sep. 25, 1978

[51] Int. Cl.[2] ..... B26D 5/38

[52] U.S. Cl. ..... 83/364; 83/156; 83/205; 83/367; 83/372; 355/13

[58] Field of Search ..... 83/364, 156, 205, 203, 83/283, 367, 372; 355/13

[56] References Cited

U.S. PATENT DOCUMENTS

| | | | |
|---|---|---|---|
| 1,814,586 | 7/1931 | Crosby | 83/364 X |
| 3,706,490 | 12/1972 | Aasen et al. | 355/13 |
| 3,722,340 | 3/1973 | Kobayashi | 83/203 |
| 3,797,931 | 3/1974 | Miciukiewicz et al. | 355/13 |
| 3,830,124 | 8/1974 | Ravera et al. | 83/205 |
| 3,951,023 | 4/1976 | Ashburner | 83/205 X |

*Primary Examiner*—Frank T. Yost

*Attorney, Agent, or Firm*—Cruzan Alexander; Donald M. Sell; Robert L. Marben

[57] ABSTRACT

Apparatus and control circuitry used in a copy machine for providing copy paper cut to length in accordance with an original sheet sensed by two switches in the path of travel of the original. A first feed roller is rotated via a clutch upon energization of a solenoid for the cluch when the leading edge of the original is sensed by the first switch with the clutch disengaged upon deenergization of the solenoid when the leading edge of the original reaches the second switch to provide limited movement of the leading edge of the copy paper from a solenoid operated cutter to a second feed roller. The second feed roller continues to pull copy paper from the roll until the cutter is operated by energization of its solenoid upon passage of the trailing edge of the original past the first switch. The cutter solenoid is deenergized when the trailing edge passes the second switch.

3 Claims, 2 Drawing Figures

COPY MACHINE WITH AUTOMATIC ROLL SUPPLIED COPY PAPER FEEDING AND CUTTING APPARATUS AND CONTROL CIRCUITRY

BACKGROUND OF THE INVENTION

1. Field of the Invention

This invention relates generally to roll-fed copying machines and more particularly to the apparatus and control circuitry for dispensing cut lengths from a roll of copy sheet material in accordance with varying size originals and wherein switches responsive to the presence and absence of an original are used in the control circuitry.

While roll-fed copy machines are known which use one or more switches that are operated in accordance with the presence or absence of original sheets fed into the machine and/or the presence or absence of copy paper for controlling the movement of copy sheet material from a supply and the cutting of the material to length corresponding to the length of the originals, such prior arrangements are complex and relatively expensive. For example, the prior arrangements may require the use of special circuit components to provide pulsed operation of solenoids or the use of expensive continuous duty solenoids. In addition, many of the prior art arrangements require special control features or mechanisms to avoid jamming of copy paper at the cutter when the cutter is operated.

SUMMARY OF THE INVENTION

The complexity and expense involved in prior copy machines is reduced by this invention. The invention is utilized in an electrically operated copy machine having a transferring mechanism driven by a drive motor for providing synchronous movement in the copy machine of copy paper and original sheets of varying lengths. The copy paper for the machine is provided by a continuous web of copy paper from a copy paper supply roll. The invention provides apparatus and circuitry used in the copy machine which is responsive to the presence and absence of the original for cutting sheets from the copy paper which correspond to the length of the original and includes first and second copy paper feed rollers which are a part of the transferring mechanism. The first feed roller is positioned along the path of travel of the copy paper between the copy paper supply roll and said second feed roller. A solenoid operated cutter is positioned between the first and second feed rollers.

A solenoid controlled clutch is used for operatively connecting the first feed roller to the drive motor. The solenoid is energized only for the time necessary to have the first feed roller move the copy paper from an initial position at the cutter to the second feed roller which then continues to draw copy paper from the copy paper supply roll. Energization of the solenoid for the clutch and the solenoid for the cutter are controlled by two switches which are spaced apart a short distance and along the path of travel of an original sheet presented to the copy machine. The switches are connected so one is connected to one conductor for the electrical power that is applied to the copier with the other switch connected to the second conductor used to receive the electrical power. Each of the switches have a first and second position, the first position provided when an original sheet is not presented to the switch with the second position provided when an original sheet is presented to the switch. Referring to the two switches as first and second switches in accordance with the order in which the two switches detect the leading edge of an original sheet, the second position for the first switch is used to connect one end of the winding of the clutch solenoid to the one power conductor with the first position of the second switch used to connect the other end of the winding of the clutch solenoid to the second power conductor. Accordingly, the clutch solenoid is operated when the leading edge of an original is initially detected by the first switch and is deenergized shortly thereafter when the leading edge of the original reaches the second switch to place it in its second position from its first position. The winding of the solenoid for the cutter has one end connected to the one power conductor by the first switch when it is in its first position with the other end of the winding connected to the second power conductor by the second switch when it is in its second position. Accordingly, the cutter solenoid is operated to cut the copy paper when an original presented to the copy machine has reached the second switch placing it in its second position and the trailing edge is detected by the first switch causing it to assume its first position.

With the foregoing arrangement provided by the present invention, the cutter solenoid and the clutch solenoid are only energized for a brief period of time allowing intermittent rather than continuous duty type solenoids to be utilized.

In addition, with the feed roller not active to push the copy paper into the cutter at the time the cutter is operated, any jamming of copy paper at the cutter is avoided.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION

Figure 1:
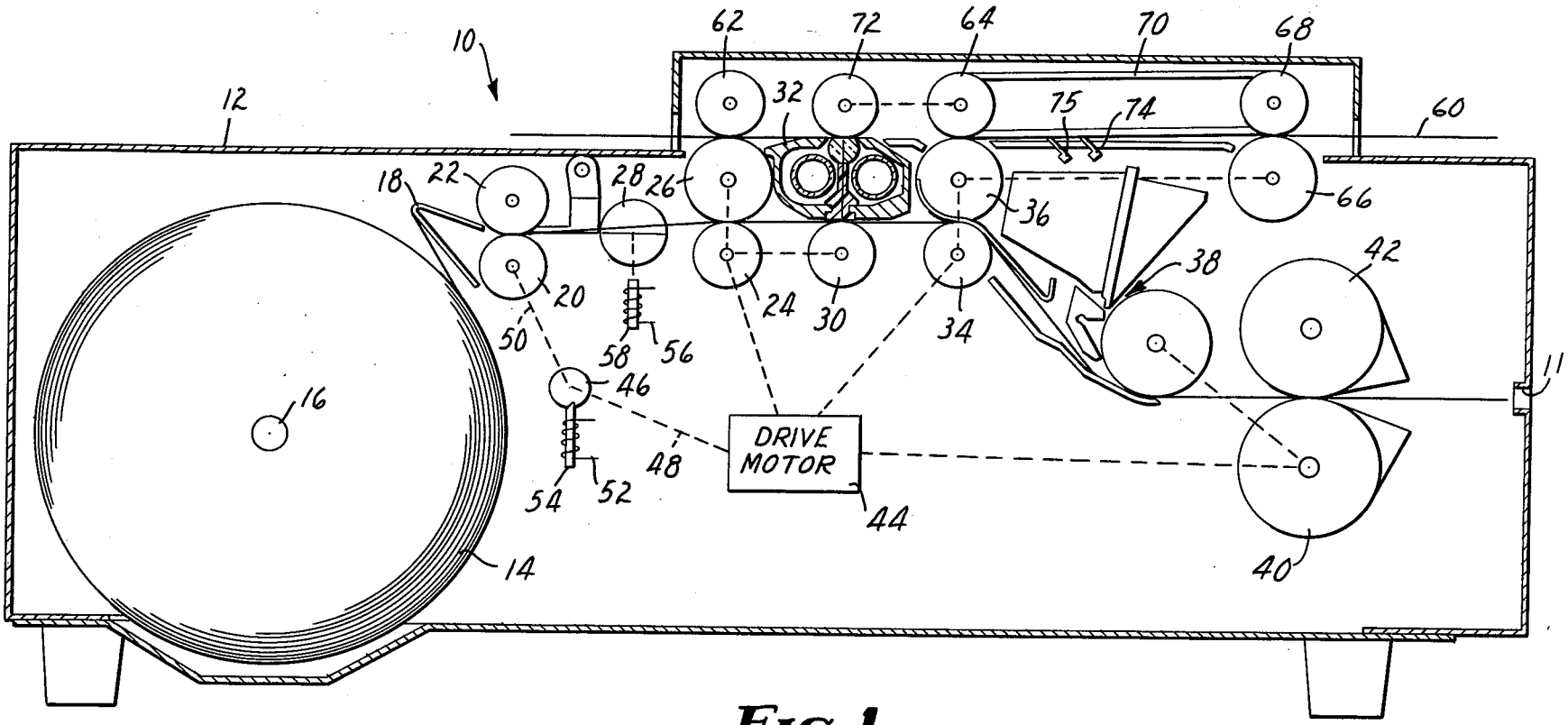
FIG. 1 is a diagrammatic side elevational view of an electrically operated copy machine with only a portion of the control circuitry of the present invention shown.

Referring to FIG. 1 a diagrammatic side elevational view of an electrically operated copy machine 10 is shown in part which includes a housing 12 in which a copy paper supply roll 14 is positioned for rotation counterclockwise about the axis for the roll indicated at 16. For the type of copy machine to be described, the copy paper is a zinc oxide coated paper such as that available from the Minnesota Mining and Manufacturing Company under the designation Type 470. The copy paper is moved through the copy machine by a transferring mechanism which includes a first feed roller 20 which receives the copy paper from the supply roll 14 via a guide member 18, an idler roller 22 above roller 20 between which the copy paper is moved when roller 20 is driven, a second feeder roller 24 and a cooperating charge roller 26 positioned above roller 24 which also serves to place a uniform electrical charge on the zinc oxide surface of the copy paper, a roller 30 which receives the copy paper from rollers 24 and 26 and keeps it in close contact with the exposure station, indicated generally at 32, drive roller 34 plus roller 36 positioned above roller 36 which receive the paper from roller 30 and move it past a developer station, indicated generally at 38, and a driven pressure roller 40 and a cooperating idler roller 42 positioned above the roller 40 which receive the copy paper from the rollers 34 and 36 and move the copy paper via an opening 11 in the housing 12 to an area outside of the housing. The path taken by the copy paper is shown by the solid line that extends from the copy paper to the right side of the housing.

A drive motor 44 is also a part of the transferring mechanism and provides the driving force for the transferring mechanism. A direct drive connection, indicated by dotted lines, is provided between the drive motor 44 and feed roller 24, drive roller 34 and roller 40. A chain drive (not shown) may be used to provide the direct drive connection. The drive motor 44 is also operatively connected to drive the feed roller 20 via a solenoid operated clutch 46 as indicated by the dotted line 48 between motor 44 and clutch 46 and the dotted line 50 between the clutch 48 and feed roller 20. The drive relationship between the clutch 46 and the motor 44 and between the clutch 46 and the feed roller 20 is only diagrammatically shown.

The clutch 46 may be a spring clutch available from the PSI Division of Warner Electric Brake and Clutch Company, P.O. Box 118, Pittman, New Jersey 08071 under stock number 501581. The clutch 46 is controlled by a solenoid which includes a winding 52 and an armature 54. When the winding 52 is energized the armature 54 moves allowing the clutch 46 to couple the drive motor 44 to the feed roller 20. If the winding 52 is deenergized before the clutch 46 rotates one revolution, the clutch is engaged by the armature to terminate movement of the roller 20 after one revolution of the clutch. As will be explained later, one revolution of roller 20 is required when making a copy using the machine shown in FIG. 1.

A solenoid controlled cutter 28 is provided along the path of the copy paper and is positioned between the first feeder roller 20 and the second feeder roller 24. Normally the copy paper will be at the cutter 28 when a copy has been made with the cutter bar portion of the cutter 28 positioned to allow paper to move to the second feed roller 24 when the first feed roller 20 is driven. The spacing between the cutter 28 and the roller 24 is such that only one revolution of the feed roller 20 is required to bring the copy paper to the second feed roller 24. The solenoid for cutter 28 includes a winding 56 and an armature 58 which is operatively connected, as indicated by the dotted line, to the cutting bar potion of the cutter 28. The cutter 28 is moved to the cutting position when the winding 56 is energized. Solenoid controlled cutters of the type described for severing paper presented to it from a feed roller are well known in the art.

It is necessary when making a copy of an original sheet that movement of the original sheet to be copied and the copy paper be synchronized so their leading edges reach the exposure station 32 at the same time. The transferring mechanism of the copy machine that serves to provide such movement of an original sheet includes a portion of the transferring mechanism used in moving copy paper through the machine. An original passes in FIG. 1 from right to left along the path indicated by the line 60.

The charge roller 26 and the feed roller 24, which are used in the transferring mechanism for the copy paper, are also used directly as part of the transferring mechanism for the original sheets presented to the copier. Roller 24 is coupled, as indicated by the dotted line, to drive charge roller 26. Gears can be used to provide the coupling. An idler roller 62 is positioned above and cooperates with roller 26. A similar coupling arrangement is provided between rollers 34 and 36 with roller 64 positioned above roller 36. The roller 36 is also coupled, as indicated by the dotted line, to drive a feed roller 66 positioned at the right portion of the machine where an original is initially inserted. The roller 36 may be coupled to the feed roller 66 by a timing belt (not shown). The feed roller 66 has a roller 68 positioned above it which is coupled to the roller 64 by a number of "o" ring belts 70 (only one is shown) positioned along the rollers 68 and 64. A roller 72 is positioned adjacent the exposure station 34 diametrically opposite the roller 30. The roller 72 is biased toward the exposure station and is a driven roller being coupled, as indicated by the dotted line, to roller 64. Such coupling can be provided by a timing belt (not shown). With the drive motor 44 for the transferring mechanism operating, the portion of transferring mechanism is effective to move an original sheet along the path indicated by the line 60 carrying the original past the exposure station 32 to an exit point to the left of rollers 26 and 62.

Two snap acting type switches 74 and 75, each of the single pole, double throw configuration, are positioned in the flow path for the original. Switches of this type are well known and are commercially available from several sources. Switch 74 is the first switch to be operated by the leading edge of an original sheet and is positioned so its actuation in response to the leading edge occurs when the leading edge is at distance from the center of the exposure station 32 that is equal to the distance that the leading edge of the copy paper, which is at the cutter 28, travels to reach the center of the exposure station 32 following energization of the winding 52. Switch 75 is positioned a short distance away from switch 74. As will be explained, the actuation of switch 74 in response to the leading edge of the original is effective to energize the winding 52 of the solenoid for clutch 46 to release clutch 46 allowing the feed roller 20 to be driven. Switch 75 is spaced from switch 74 so the actuation of switch 75 in response to the leading edge of the original occurs before the feed roller 20 has rotated a full revolution due to release of the clutch 46. As will be explained, such actuation of switch 75 is utilized to denergize the winding 52 for the clutch solenoid allowing the armature 54 to return to a position to stop operation of the clutch upon completion of the one revolution of roller 20.

Figure 2:
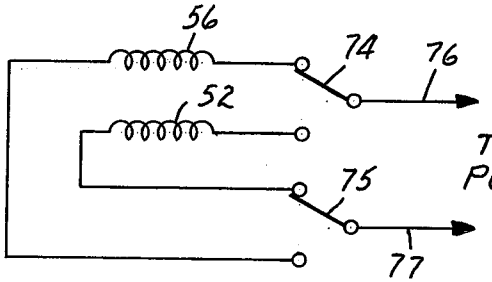
FIG. 2 is schematic of the control circuitry of the present invention for use with the copy machine of FIG. 1.

A circuit utilizing switches 74 and 75 is shown in FIG. 2. The position in which the switches are shown shall hereinafter be referred to as the first position. It is the position the switches assume when they are not responding to the presence of an original sheet. The other position, which is assumed by each of the switches when responding to an original sheet, shall hereinafter be referred to as the second position. Electrical power when applied to the copy machine appears across the two conductors 76 and 77. Switches 74 and 75 are shown with their movable contact connected to power conductors 76 and 77, respectively. The fixed contact associated with the first position for switch 74 is connected to one end of the winding 56 for the cutter solenoid, while the fixed contact for the second position of switch 74 is connected to one end of winding 52 for the clutch solenoid. Referring to switch 75, the fixed contact for its first position is connected to the other end of the winding 52 of the clutch solenoid, while the fixed contact for its second position is connected to the other end of the winding 56 for the cutter solenoid.

Operation of the circuit of FIG. 2 in conjunction with movement of the copy paper and an original sheet through the copy machine will be described. Prior to the insertion of an original sheet into the copy machine the circuit of FIG. 2 is as shown wherein each of the windings 52 and 56 are deenergized so the leading edge of the copy paper is at the cutter 28 where it remains until the clutch 46 is released by energization of the solenoid winding 52 to cause feed roller 20 to be driven. Assuming the drive motor is energized, the original sheet is carried by the roller 66 and 68 and the "0" ring belts 70 toward the snap switch 74. Upon actuation of the switch 74 to its second position by the leading edge of the original sheet, electrical power is applied from power conductor 76 to the winding 52 for the clutch solenoid via the second position of switch 74 and the first position of switch 75 to the other power conductor 77. With the clutch solenoid winding 52 energized the clutch 46 is released causing the drive motor to drive the feed roller 20 to start the movement of the leading edge of the copy paper toward the driven feed roller 24. The leading edge of the original sheet continues its movement to actuate switch 75 placing it in its second position causing the winding 52 of the clutch solenoid to be deenergized. The distance between switches 74 and 75 is short enough that deenergization of winding 52 occurs before roller 20 has made one revolution to cause the armature of the solenoid to disengage the clutch from the roller 20 upon completion of one revolution of roller 20. The spacing of rollers 24 and 26 from the cutter 28 is such that one revolution of roller 20 is sufficient to move the leading edge of the copy paper from the cutter 28 to rollers 24 and 26 so movement of the copy paper is continued by rollers 24 and 26 following the one revolution of roller 20.

Movement of the copy paper via rollers 24 and 26 and the original sheet via rollers 66 and 68 plus rollers 36 and 64 causes both leading edges to reach the center of the exposure station 32 at the same time causing an electrical charge image to be placed on the copy paper in accordance with the light energy directed from the original to the copy paper via the exposure station. During further travel the copy paper proceeds via rollers 34 and 36 past the developer station 38, where toner is deposited on the copy pper in accordance with charge image, to the pressure fuser station provided by rollers 40 and 42 where the toner image is fused to the copy paper by pressure.

When the trailing edge of the original sheet reaches the switch 74 permitting it to return to its first position, the power circuit for the cutter solenoid winding 56 is completed by the first position of switch 74 and the second position of switch 75. Energization of winding 56 causes the cutter 28 to be operated to sever the copy paper at the cutter allowing the severed portion, which is cut the length of the original sheet presented to the copy machine, to complete its path through the copy machine in synchronism with passage of the original sheet through the copy machine. The winding 56 is deenergized as the trailing edge of the original leaves switch 75 to cause it to return to its first position.

It will be noted from the foregoing description of the operation of the circuit of FIG. 2 that neither of the windings 52 or 56 for the solenoids remain energized for any appreciable time making it possible to use solenoids which are of the intermittent duty type rather than of the constant duty type as are required by other cut-to-length arrangements for copy machines and the like.

The embodiments described required driven rotation of roller 20 for only one revolution. More than one driven revolution of the roller 20 can be obtained if necessary by proper spacing of switch 75 from switch 74 should the design of a copy machine require the second feed roller 24 to be spaced at a greater distance from the cutter 28 than is the case for the embodiment described.

It is, of course, readily apparent that instead of using a snap switch of the single pole, double throw type for switches 74 and 75, two switches can be used in place of switch 74 and two in place of switch 75. Each would be single pole, single throw type snap switch with one of each pair having a normally open contact and one having a normally closed contact.

What is claimed is:

1. An electrically operated copy machine having a transferring mechanism driven by a drive motor for providing synchronous movement in the copy machine of copy paper and original sheets of varying lengths where the copy paper is provided by a continuous web of copy paper from a copy paper supply roll and apparatus and circuitry responsive to the presence and absence of the original for cutting sheets from the copy paper which correspond to the length of the original including:

first and second copy paper feed rollers included in the transferring mechanism, said first feed roller positioned between the copy paper supply roll and said second feed roller;

first and second solenoids, each having a winding;

a cutter positioned in the path of travel of the copy paper between said first and second feed rollers and operatively connected to said first solenoid;

first and second electrical power conductors, each connected to a different side of the electrical power presented during operation of the copy machine;

first and second switch means connected to said first and second conductors, respectively, said first and second switch means spaced a short distance apart and positioned along the path of travel of an original sheet for responding to the presence and absence of original sheets presented to the copy machine, said first switch means positioned first in the path of travel of an original sheet, said first switch means connecting one end of the winding of said first solenoid to said first conductor when an original sheet is not presented to said first switch means and connecting one end of the winding of said second solenoid to said first conductor when an original sheet is presented to said first switch means, said second switch means connecting the other end of the winding of said second solenoid to said second conductor when an original sheet is not presented to said second switch means and connecting the other end of the winding of said first solenoid to said second conductor when an original sheet is presented to said second switch means; and a clutch adapted for control by said second solenoid and operatively engaged between the drive motor and said first feed roller for providing sufficient rotation of said first feed roller to move the copy paper from said cutter to said second feed roller following energization of said second solenoid in response to detection of the leading edge of an original sheet at said first switch means and deenergization of said second solenoid in response to detection of the leading edge of the original sheet at said second switch means.

2. An electrically operated copy machine in accordance with claim 1 wherein said first switch means is a snap switch and said second switch means is a snap switch.

3. An electrically operated copy machine in accordance with claim 1 wherein each of said first and second switch means are a snap switch that is a single pole, double throw type.

* * * * *